US010321546B2

(12) United States Patent
Gal

(10) Patent No.: US 10,321,546 B2
(45) Date of Patent: Jun. 11, 2019

(54) SYSTEM AND METHOD FOR CONTROLLING A GROUP OF LIGHTING MODULES

(71) Applicant: TAOLIGHT COMPANY LIMITED, Hong Kong (CN)

(72) Inventor: Jean-Philippe Gal, Hong Kong (CN)

(73) Assignee: WIZCONNECTED COMPANY LIMITED, Hong Kong (CN)

( * ) Notice: Subject to any disclaimer, the term of this patent is extended or adjusted under 35 U.S.C. 154(b) by 0 days.

(21) Appl. No.: 15/505,877

(22) PCT Filed: Dec. 3, 2015

(86) PCT No.: PCT/CN2015/096348
§ 371 (c)(1),
(2) Date: Feb. 22, 2017

(87) PCT Pub. No.: WO2017/092010
PCT Pub. Date: Jun. 8, 2017

(65) Prior Publication Data

US 2018/0279452 A1 Sep. 27, 2018

(51) Int. Cl.
*H05B 33/08* (2006.01)
*H05B 37/02* (2006.01)

(52) U.S. Cl.
CPC ..... *H05B 37/0272* (2013.01)

(58) Field of Classification Search
None
See application file for complete search history.

(56) References Cited

U.S. PATENT DOCUMENTS

| | | | |
|---|---|---|---|
| 5,637,964 | A | 6/1997 | Hakkarainen et al. |
| 2012/0025717 | A1 | 2/2012 | Klusmann et al. |
| 2014/0062334 | A1 | 3/2014 | Nagazoe et al. |
| 2014/0240165 | A1 | 8/2014 | Cornett et al. |

FOREIGN PATENT DOCUMENTS

| | | | | |
|---|---|---|---|---|
| CN | 2615785 | * | 5/2004 | ..... H05B 37/02 |
| CN | 201555127 | U | 8/2010 | |
| CN | 102510628 | A | 6/2012 | |
| CN | 102791056 | A | 11/2012 | |
| CN | 203225924 | U | 10/2013 | |
| JP | 9-106706 | A | 4/1997 | |
| JP | 2002-110369 | A | 4/2002 | |
| JP | 2012-104301 | A | 5/2012 | |
| JP | 2012-523658 | A | 10/2012 | |
| JP | 2014-44916 | A | 3/2014 | |

* cited by examiner

*Primary Examiner* — Dedei K Hammond
(74) *Attorney, Agent, or Firm* — Seed IP Law Group LLP

(57) ABSTRACT

A system for controlling a group of lighting units, the system including a narrow-beam infrared remote control unit configured for communicating a first control signal to a first lighting unit of the group of lighting units via an infrared frequency communication link, wherein the first lighting unit is configured to: (a) perform an operational mode in response to the received first control signal; and (b) communicate a second control signal from the first lighting unit to at least a second lighting unit of the group of lighting units via a first radio frequency communication link whereby said second lighting unit is configured to perform an operational mode in response to the received second control signal.

9 Claims, 3 Drawing Sheets

SYSTEM AND METHOD FOR CONTROLLING A GROUP OF LIGHTING MODULES

TECHNICAL FIELD

The present invention relates to systems and methods for controlling lighting units in household and commercial environments.

BACKGROUND OF THE INVENTION

There is a perceived need to improve the manner in which users are able to control groups of lighting units such as lamps, luminaries, spotlights and the like in household and commercial environments.

Certain existing control systems involve the use of an infrared (IR) remote control unit to interact with the different lighting units in the environment by transmitting IR control signals to each of the light units in the system that are equipped with IR communication module interfaces and processing circuitry so as to respond to the received IR signals. The use of an IR remote control can be problematic in that when a wide-beam IR remote control is simultaneously used to control a group lighting units, the wide-beam of the transmitted IR signal may inadvertently interfere with other lighting units not intended to be targeted but which happen to fall within the IR beam angle. A narrow-beam IR remote control having a more directionally-focused IR beam to target a lighting unit or group of lighting units may alleviate inadvertent interference with unrelated lighting units, however, this means that the narrow-beam IR remote control can generally only be used to control each lighting unit one at a time and this is a slow and laborious process when for instance activating or deactivating a large group of lighting units.

In alternate control systems, a smartphone may be configured to run a software application thereon to provide a user interface via which a user is able to interface with and control operation of various lighting units in a given environment via a WI-FI network. However, the use of a smartphone as the user-control device makes it difficult for the user to simultaneously used the smartphone for other functions such as making telephone calls, browsing the Internet or playing audio/video files.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a system for controlling a group of lighting units, the system including a narrow-beam infrared remote control unit configured for communicating a first control signal to a first lighting unit of the group of lighting units via an infrared frequency communication link, wherein the first lighting unit is configured to:

(a) perform an operational mode in response to the received first control signal; and (b) communicate a second control signal from the first lighting unit to at least a second lighting unit of the group of lighting units via a first radio frequency communication link whereby said second lighting unit is configured to perform an operational mode in response to the received second control signal.

Preferably the present invention may include a radio frequency remote control unit configured for communicating with the first lighting unit and the second lighting units via a second radio frequency communication link so as to define the first lighting unit and the second lighting unit as part of the group of lighting units.

Typically, the radio frequency remote control unit may include at least one of a mobile telephone device, a tablet type device, a desktop computer device, a portable computer device, and a personal digital assistant.

Typically, the radio frequency remote control unit may include a software application module operable for running on the radio frequency remote control unit to provide a user-interface for controlling the group of lighting units.

Preferably, the radio frequency remote control unit may be, in response to a user input command entered via the user-interface, configured for programming at least one of the first and second lighting units in the group of lighting units to perform user-defined operational modes, and wherein the narrowband infrared remote control unit may thereafter be configured for selectably controlling the at least one of the first and second lighting units to perform any one of the user-selected operational modes that have been programmed into the at least one of the first and second lighting units.

Preferably, the first and second radio frequency communication links may include at least one of a WI-FI type and a Bluetooth type radio frequency communication link.

Typically, in response to the received second control signal, the second lighting unit may be configured to perform substantially the same operational mode as performed by the first lighting unit in response to receiving the first control signal.

Typically, the operational modes performed by the first lighting unit and the second light unit may include at least one of outputting a colour output mode, a brightness dimming mode, and switching the first lighting unit on or off.

Preferably, the first lighting unit and the second lighting unit may include an inbuilt WI-FI communication module for receiving and transmitting WI-FI signals and an infrared communication module for receiving and transmitting infrared signals.

In certain embodiments of the present invention, the infrared remote control unit and the radio frequency remote control may be integrally formed in a common device.

In a further broad form, the present invention provides a system for controlling a group of lighting units, the system including a narrow-beam infrared remote control unit configured for communicating a first control signal to a signaling device via an infrared frequency communication link, wherein the signaling device is configured to communicate a second control signal to at least a first lighting unit and a second lighting unit of the group of lighting units via a first radio frequency communication link whereby said first lighting unit and said second lighting unit are configured to perform operational modes in response to the received second control signal.

In a further broad form the present invention provides a kit including a narrow-beam infrared remote control unit, a first lighting unit and a second lighting unit, wherein:

(i) the narrow-beam infrared remote control unit is configured for communicating a first control signal to the first lighting unit via an infrared frequency communication link, wherein the first lighting unit is configured to:

(a) perform an operational mode in response to the received first control signal; and (b) communicate a second control signal from the first lighting unit to the second lighting unit via a first radio frequency communication link whereby said second lighting unit is configured to perform an operational mode in response to the received second control signal.

Typically, the kit may include a signaling device wherein

In a further broad form, the present invention provides a method for controlling a group of lighting units, the method including the steps of using a narrow-beam infrared remote control unit to communicate a first control signal to a first lighting unit of the group of lighting units via an infrared frequency communication link, wherein the first lighting unit is configured to:

(a) perform an operational mode in response to the received first control signal; and (b) communicate a second control signal from the first lighting unit to at least a second lighting unit of the group of lighting units via a first radio frequency communication link whereby said second lighting unit is configured to perform an operational mode in response to the received second control signal.

Preferably, the method may include a step of using a radio frequency remote control unit to communicate with the first lighting unit and the second lighting units via a second radio frequency communication link so as to configure the first lighting unit and the second lighting unit as part of the group of lighting units.

Typically, the radio frequency remote control unit may include at least one of a mobile telephone device, a tablet type device, a desktop computer device, a portable computer device, and a personal digital assistant.

Preferably, the present invention may include a step of providing a software application module operable for running on the radio frequency remote control unit to function as a user-interface for controlling the group of lighting units.

Preferably, the radio frequency remote control unit may, in response to a user input command entered via the user-interface, be configured for programming at least one of the first and second lighting units in the group of lighting units to perform user-defined operational modes, and wherein the narrowband infrared remote control unit may thereafter be configured for selectably controlling the at least one of the first and second lighting units to perform any one of the user-selected operational modes that have been programmed into the at least one of the first and second lighting units.

Preferably, the first and second radio frequency communication links may include at least one of a WI-FI type and a Bluetooth type radio frequency communication link.

Preferably, in response to the received second control signal, the second lighting unit may be configured to perform substantially the same operational mode as performed by the first lighting unit in response to receiving the first control signal.

Typically, the operational modes performed by the first lighting unit and the second light unit may include at least one of outputting a colour output mode, a brightness dimming mode, and switching the first lighting unit on or off.

Preferably, the first lighting unit and the second lighting unit may include an inbuilt WI-FI communication module for receiving and transmitting WI-FI signals and an infrared communication module for receiving and transmitting infrared signals.

It will be apparent that embodiments of the present invention provide a number of advantages including amongst other things:

(i) it allows a group of lighting units to be simultaneously controlled by a narrow-beam infrared remote control with a single control signal transmission from an infrared remote control whilst alleviating inadvertent interference with lighting units not within the group; and (ii) it conveniently provides a hybrid control system comprising a narrow-beam IR remote control in combination with a radio-frequency remote control to control different groups of lighting units in an environment. In particular, the narrow-beam IR remote control is a relatively cost effective and low-complexity device to manufacture which may provide a pre-configured "out-of-the-box" control unit for use in immediate control of day-to-day functions of the lighting units (e.g. on/off switching, brightness dimming levels, colour scene modes etc). The use of a radio-frequency remote control device in combination with the narrow-beam infrared remote control is also convenient in that it may be used to provide control of lighting unit settings such as defining lighting groups and so on. Such settings need not be configured daily and so the use of a smartphone for instance as the radio-frequency remote control device will not interfere with use of the smartphone for other functions such as making telephone calls, Internet browsing and so on.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Preferred embodiments of the present invention will now be described with reference to the drawings.

Referring to FIGS. 1-4, a first embodiment system is shown comprising a first group of lighting units (G1) comprising lamps providing ambient lighting, a second group of lighting units (G2) comprising directionally-focused spotlights, and both a narrow-beam infrared (IR) (400) and a radio frequency (RF) remote control unit (300) for controlling operational settings of the first and second groups of lighting units (G1,G2).

Figure 1:
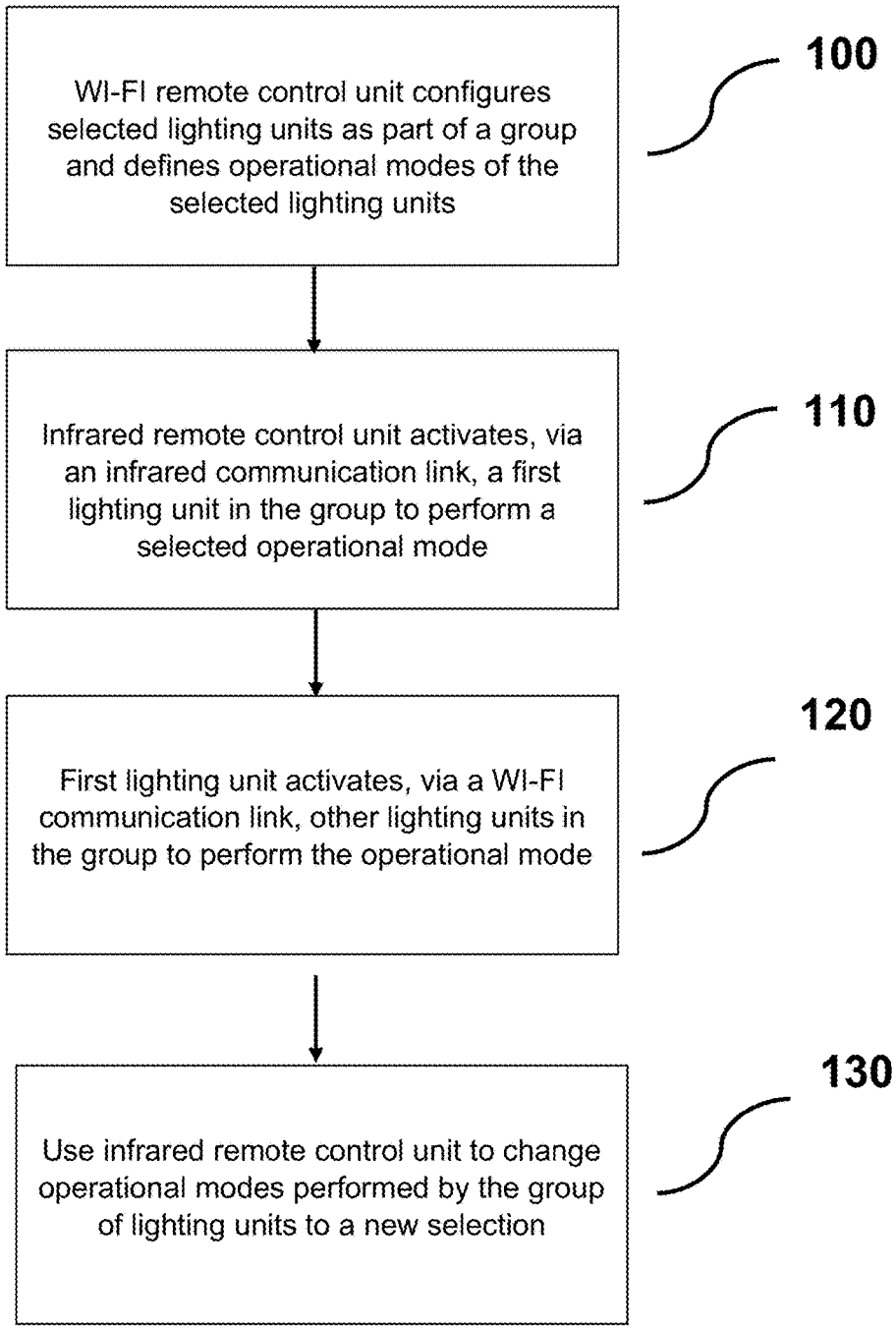
FIG. 1 shows a flow-diagram of method steps for controlling a group of lighting units in accordance with an embodiment of the present invention.
Figure 2:
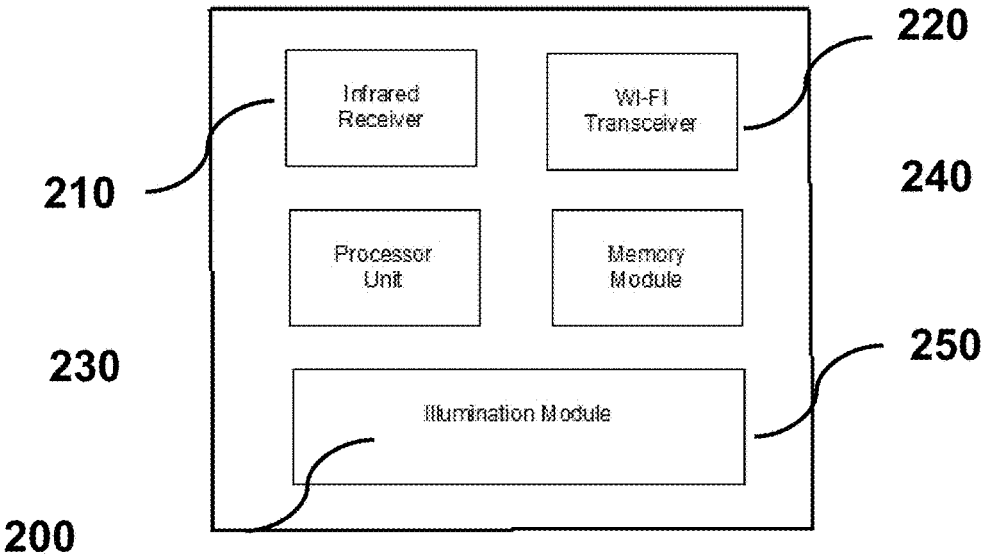
FIG. 2 shows a functional block diagram of a lighting unit used in embodiment systems of the present invention.

As shown in FIG. 2, each of the lighting units (200) in the first and second groups of lighting units (G1,G2) comprise an IR communication module (210) having an IR receiver for receiving IR control signals from the IR remote control as well as a radio frequency (RF) communication module (220) comprising an RF receiver and transmitter unit for communication via RF signaling links with other lighting units as well as with the RF remote control unit. In this embodiment the IR communication module and the RF communication module are integrally formed in the circuitry of each lighting unit. Each lighting unit also includes a processor unit (230) and a memory module (240) for storing software programs and data required to perform basic functions as well as to store user-defined settings relating to operational modes which may be performed by the lighting units (200) in response to user commands received via the IR and RF remote control units during operation of the system.

Figure 3:
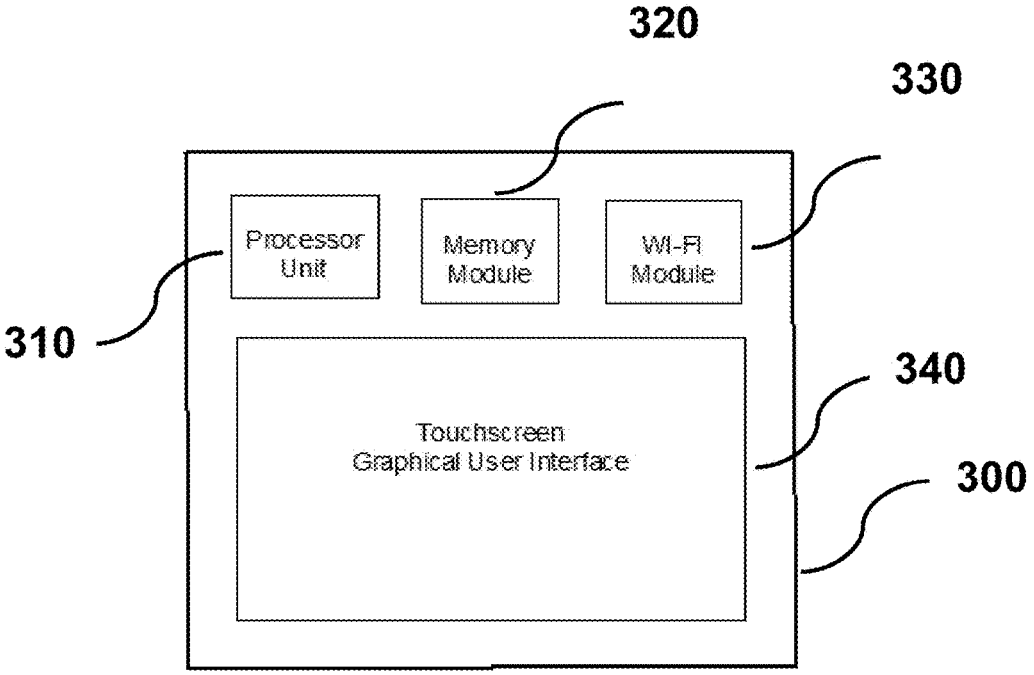
FIG. 3 shows a functional block diagram of a radio-frequency remote control unit in accordance with an embodiment of the present invention.

Referring now to FIG. 3, the RF remote control unit (300) includes a processor unit (310), a memory module (320), a WI-FI transceiver module (340) for providing WI-FI based signaling compliant with WI-FI standard communication protocols, and a touchscreen display (340). In alternate embodiments it is possible that the RF remote control unit (300) may operate based on Bluetooth radio frequency communication standards and protocols or any other suitable radio frequency platform technology without departing from the overall objectives and spirit of the invention. Although an application specific RF remote control unit may be provided for use with this system, a smartphone having an in-built WI-FI transceiver module may conveniently utilised as the RF remote control unit. A software application may be downloaded into a memory module (320) of the smartphone via the Internet (or other communication network) from an online server. The software application is operable on the smartphone to provide a graphical user-interface on the touchscreen display (340) of the smartphone via which a user may interact with and control various settings of the lighting units in the system. It would be appreciated that in alternative embodiments, a tablet type device, a desktop computer device, a portable computer device, a personal digital assistant and so on may also conceivably be configured for use as the RF remote control unit if so required.

The RF remote control unit (300) is configured to, amongst other things, allow the user to define specific groups of lighting units (G1,G2) from amongst the plurality of lighting units present within the system. This step is broadly represented by block (100) in the flow diagram of FIG. 1. To accomplish this function, the graphical user interface (340) is configured to display to the user a listing of all visible lightning units that are in communication with the smartphone via a WI-FI network. The user may then selectably define via the graphical user interface (340), different groups of lighting units (G1,G2) from amongst the listing of available lighting units. Any number of different groups of lighting units may be created and any given lighting unit may be defined as falling within one or more such groups. When the user selectably defines the lighting units in any given group, the RF remote control (300) transmits a control signal to each of the selected lighting units via the WI-FI signaling link (420) whereby each of the selected lighting units in a defined group store settings information in their respective memory modules indicating which group(s) of lighting units they are defined within. Accordingly, during operation, each lighting unit is able to recognize when it is expected to function in a particular manner according to group lighting behavior by reference to its group settings information stored in its memory module (240).

In the exemplary embodiment shown in the drawings, the first and second groups of lighting units (G1,G2) are each comprised of homogenous types of lighting units whereby the first and second groups of lighting units (G1,G2) are comprised of lamps and spotlights respectively which are generally used for providing different lighting characteristics and effects. However, it is possible for a user to selectably define groups of lighting units via the graphical user-interface (340) of the RF remote control unit (300) which may be comprised by different types of lighting units having different lighting characteristics.

Figure 4:
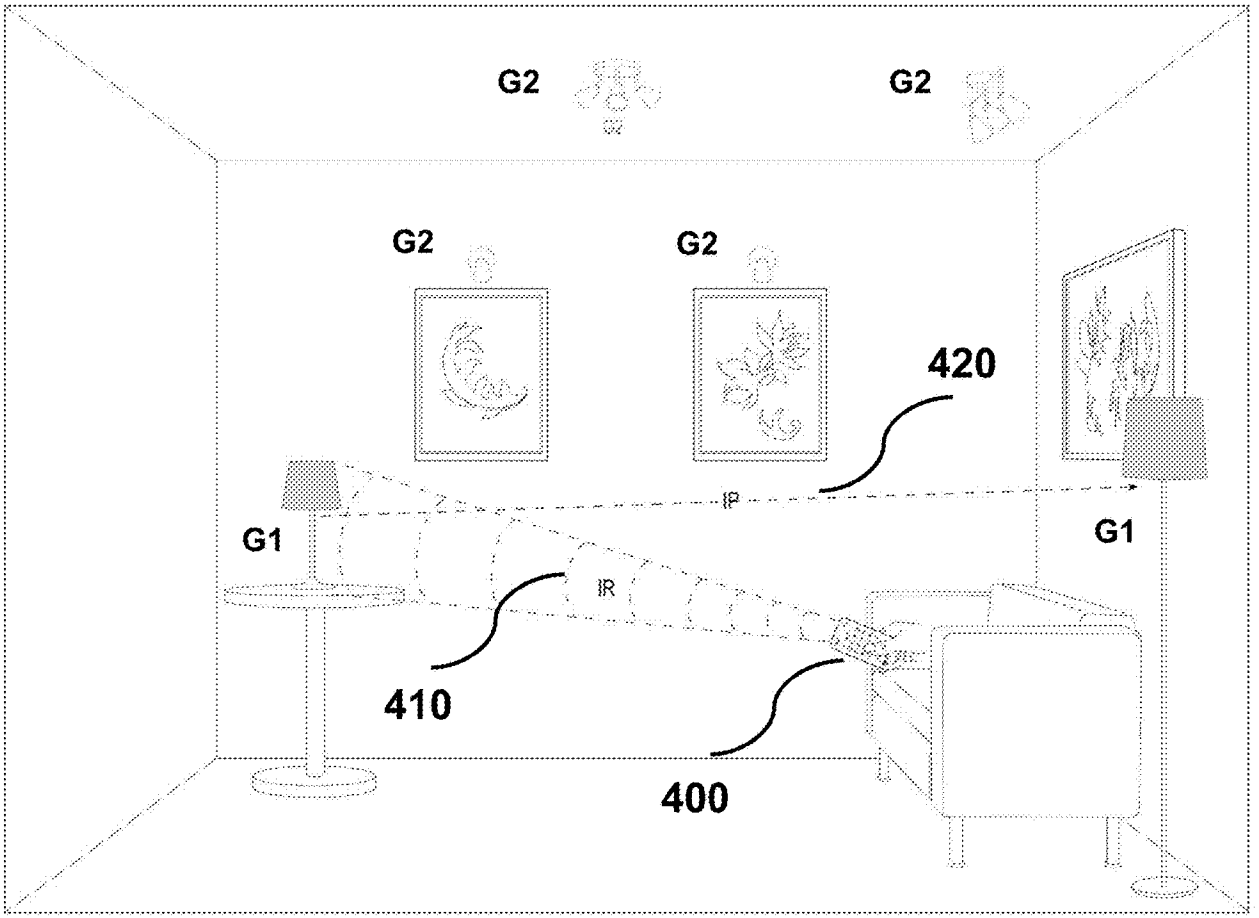
FIG. 4 shows a typical environmental setting in which two groups of lighting units are positioned and controllable by a hybrid control system comprising a narrow-beam remote control and a radio-frequency remote control

The IR remote control (400) includes an IR transmitter module configured for transmitting IR control signals to each of the lighting units or a group of lighting units. As depicted in FIG. 4, the IR beam (420) is suitably directionally-focused so as to alleviate inadvertent interference with lighting units that are not intended to be targeted by the transmitted IR beam control signal (e.g. the G2 group lighting units). The narrow-beam IR remote control (400) may be configured to output directionally focused IR beams (420) by any suitable mechanical, optical lens or other means and techniques.

The IR remote control includes a keypad with buttons that are pre-configured to transmit a standardised set of encoded IR control signals to each of the lighting units in the system. The processor units of each of the lighting units in the system may be programmed to recognise different standardised encoded IR control signals that are output by the IR remote control in response to actuation of its keypad buttons. The control signals may control operational functions and settings of the lighting units required on a daily basis such as switching on or off of a lighting unit, adjustment of a brightness dimming level, outputting a specific colour lighting scene and so on.

The keypad of the IR remote control may for instance include buttons which allow the user to scroll through various available colour scene modes that may be available for output by each of the lighting units in a defined group of lighting units. The number and types of colour scene modes that the lighting units in any given group of lighting units are able to display may be programmed into the lighting units by the user via the WI-FI remote control unit. The memory module (240) of each lighting unit (200) will contain data which is readable by the processor unit (230) of each lighting unit indicating the number and types of colour scene modes which the respective lighting units are able to output in response to control signals received from the IR remote control unit (400). Thus for instance, when the user actuates a scroll-through button on the IR remote control, a lighting unit receiving the control signal may progressively output each of its pre-programmed available colour scene modes until the desired colour scene mode is output. The IR remote control keypad may also include a button which actuates a timer function for activation or deactivation of lighting units in a group of lighting units so that for instance the lighting units may be timed for activation of deactivation at a specified time. Because the Wi-Fi remote control (300) is able to configure the groups of lighting units and the types of colour scene modes that may be output by lighting units in response to received IR control signals, this means that it is possible for a user to conveniently customise the response of the lighting units when buttons of the IR remote control keypad are actuated. The keypad buttons of the IR remote control are able to be customized by the user, for instance by programming the lighting units to only output a specified number of "favourite" colour scene modes in response to actuation of IR remote control buttons. Consequently, this user customization to include only a select number of functions means that the IR remote control keypad need not be so complex and bulky, and, may conveniently be provided with enhanced compactness and simplicity if so required by virtue of this customization capability.

As shown in FIG. 4, when the narrow-beam IR remote control (400) is pointed at a lighting unit in a defined group of lighting units, the IR beam (420) is received by only the target lighting unit or other lighting units in the same group of lighting units (in this case lighting group G1). This step is broadly represented by block (110) in the flow diagram of FIG. 1. Conveniently, the narrow-beam alleviates occurrence of lighting units of a different group of lighting units inadvertently receiving the IR signal and responding to the IR signal when they are not intended to do so. Conveniently, when the IR communication module of the target lighting unit receives the narrow-beam IR control signal, the processor unit of the target lighting unit will cause the lighting unit to output a functional response corresponding to the received IR control signal. The target light unit receiving the IR control signal is also configured to, in response to the received IR control signal, automatically transmit a WI-FI control signal (420) via its WI-FI communication module to the WI-FI communication modules of other lighting units in the system. This step is broadly represented by block (120) in the flow diagram of FIG. 1. The processor units of the other lighting units receiving the transmitted WI-FI control signal will recognise, based on the received WI-FI control signal, whether the signal has been sent from a lighting unit in the same defined group of lighting units, and if this is the case, will output a response corresponding to the received WI-FI control signal. The lighting units will be able to recognise whether a received WI-FI control signal has been transmitted from another lighting unit in the same defined group of lighting units by comparing the received signal (which will contain data identifying the transmitting lighting unit) against group settings data stored in the memory module of each lighting unit. Typically, the WI-FI control signal transmitted by the target lighting unit may cause all other lighting units in the same defined group to respond in the same manner although it is of course possible to configure the system so that different lighting units in a defined group of lighting units may respond in different ways in accordance with a pre-programmed group lighting behaviour/pattern. Conveniently, in this arrangement, a user may use an infrared remote control to transmit a single directionally-focused infrared control signal to only one lighting unit which is part of a defined group of lighting units with the effect that the lighting unit will conveniently transmit the WI-FI control signal to all other members of the group to perform the same lighting function (without requiring the users further input). Further control signals may be transmitted to the lighting units in the environment to change lighting characteristics again and this step is broadly represented by block (130) in FIG. 1.

In certain embodiments, it is possible that a stand-alone IR/WI-FI signaling unit may be provided as part of the system. A user may point the narrow-beam remote control at the IR/WI-FI signaling unit which upon receiving the IR control signal, will then transmit the WI-FI control signal to other lighting units in a similar manner as described above. However, in this case, the stand-alone IR/WI-FI signaling unit need not necessarily be a lighting unit itself. In yet alternate embodiments it is possible that similar arrangements may be utilised to control groups of devices which may not all necessarily include lighting units. The group of devices may for instance include a combination of lighting devices, audio/video devices, air-conditioning devices, home security devices and so on.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A system for controlling a group of lighting units, the system including a narrow-beam infrared remote control unit configured for communicating a first control signal to a first lighting unit of the group of lighting units via an infrared frequency communication link, wherein the first lighting unit is configured to:

(a) perform an operational mode in response to the received first control signal; and (b) communicate a second control signal from the first lighting unit to at least a second lighting unit of the group of lighting units via a first radio frequency communication link whereby said second lighting unit is configured to perform an operational mode in response to the received second control signal;

wherein a radio frequency remote control unit is configured for communicating with the first lighting unit and the second lighting units via a second radio frequency communication link so as to define the first lighting unit and the second lighting unit as part of the group of lighting units.

2. A system as claimed in claim 1 wherein the radio frequency remote control unit includes at least one of a mobile telephone device, a tablet type device, a desktop computer device, a portable computer device, and a personal digital assistant.

3. A system as claimed in claim 1 wherein the radio frequency remote control unit includes a software application module operable for running on the radio frequency remote control unit to provide a user-interface for controlling the group of lighting units.

4. A system as claimed in claim 1 wherein the radio frequency remote control unit is, in response to a user input command entered via a user-interface, configured for programming at least one of the first and second lighting units in the group of lighting units to perform user-defined operational modes, and wherein the narrow-beam infrared remote control unit is thereafter configured for selectably controlling the at least one of the first and second lighting units to perform any one of the user-selected operational modes that have been programmed into the at least one of the first and second lighting units.

5. A system as claimed in claim 1 wherein the first and second radio frequency communication links include at least one of a WI-FI type and a Bluetooth type radio frequency communication link.

6. A system as claimed in claim 1 wherein in response to the received second control signal, the second lighting unit is configured to perform the same operational mode as performed by the first lighting unit in response to receiving the first control signal.

7. A system as claimed in claim 1 wherein the operational modes performed by the first lighting unit and the second light unit includes at least one of outputting a colour output mode, a brightness dimming mode, and switching the first lighting unit on or off.

8. A system as claimed in claim 1 wherein the first lighting unit and the second lighting unit include an inbuilt WI-FI communication module for receiving and transmitting WI-FI signals and an infrared communication module for receiving and transmitting infrared signals.

9. A system as claimed in claim 1 where in the infrared remote control unit and the radio frequency remote control are integrally formed in a common device.

* * * * *